US005876914A

United States Patent [19]

Droin et al.

[11] Patent Number: 5,876,914

[45] Date of Patent: Mar. 2, 1999

[54] REVERSIBLE COLOR PHOTOGRAPHIC PRODUCT COMPRISING A MIXTURE OF EMULSIONS

[75] Inventors: Gerard M. Droin, Beaune; Yannick Begel, Chalon Sur Saone, both of France

[73] Assignee: Eastman Kodak Company, Rochester, N.Y.

[21] Appl. No.: 928,385

[22] Filed: Sep. 12, 1997

[30] Foreign Application Priority Data

Oct. 18, 1996 [FR] France ..... 96 12938

[51] Int. Cl.[6] ..... G03C 1/035

[52] U.S. Cl. ..... 430/567; 430/503

[58] Field of Search ..... 430/567, 503, 430/571, 379

[56] References Cited

U.S. PATENT DOCUMENTS

| | | | |
|---|---|---|---|
| 4,639,417 | 1/1987 | Honda et al. | 430/567 |
| 4,806,460 | 2/1989 | Ogawa et al. | 430/504 |
| 4,946,765 | 8/1990 | Hahm | 430/504 |
| 5,391,468 | 2/1995 | Cohen et al. | 430/503 |

FOREIGN PATENT DOCUMENTS

| | | |
|---|---|---|
| 228914 | 7/1987 | European Pat. Off. . |
| 304297 | 2/1989 | European Pat. Off. . |
| 59-137951 | 8/1984 | Japan . |
| 3-226747 | 10/1991 | Japan . |

*Primary Examiner*—John A. McPherson
*Attorney, Agent, or Firm*—Andrew J. Anderson

[57] ABSTRACT

The present invention concerns a color reversible photographic product. In particular, it concerns a silver halide photographic product which comprises a mixture of emulsions containing a tabular grain emulsion. This photographic product improves the rendering of the details of the dye image.

9 Claims, No Drawings

REVERSIBLE COLOR PHOTOGRAPHIC PRODUCT COMPRISING A MIXTURE OF EMULSIONS

FIELD OF THE INVENTION

The present invention concerns a color reversible photographic product. In particular, it concerns a silver halide photographic product in which the details of the dye image are improved.

BACKGROUND OF THE INVENTION

In conventional color photography, photographic products contain three superimposed units of silver halide emulsion layers, one to form a latent image corresponding to exposure to blue light (blue-sensitive), one to form a latent image corresponding to exposure to green and one to form a latent image corresponding to exposure to red.

During photographic processing, the developing agent reduces the silver ions of each latent image. The thus oxidized developing then reacts in each unit with a dye-forming coupler to produce yellow, magenta and cyan dye images respectively from the recordings in blue, green and red. This produces negative color images.

The reversible photographic products which enable positive images to be obtained comprise the same three superimposed units of silver halide emulsion layers, each of these units containing respectively a yellow, magenta and cyan dye-forming coupler. Following exposure, these reversible photographic products are subjected to a first black and white development (latent image development), then to a stage of chemical reversal or fogging exposure, which makes the initially unexposed silver halides developable. Following reversal, the photographic product is treated in a color developing bath in the presence of couplers, generally contained in the photographic product.

In order to reproduce detail in the dye image, it is important to use photographic products with a wide exposure latitude. The exposure latitude is a measure of the ability of a photographic product to record differences in intensity of exposure through differences in density. For a given range of exposure intensities, the more differences in density of the image are reproduced, the more details the color image has.

It is known to sensitize a layer of silver halide emulsions over more than one region of the light spectrum to improve the reproduction of details of the color image. For example, the patent application EP 304297 describes a photographic product which comprises a layer of silver halide emulsions which is chromatized in two regions of the light spectrum so as to increase the exposure latitude. U.S. Pat. No. 4,806,460 describes a photographic product which has interimage effects in which one of the sensitive layers contains at least two different dye-forming couplers or at least two spectral sensitizing dyes.

U.S. Pat. No. 4,946,765 describes a color photographic paper which comprises a first and a second layer of silver halide emulsion, each of these layers being sensitized in a different region of the light spectrum and containing a particular dye-forming coupler, the photographic product comprising a non light-sensitive intermediate layer situated between the two layers of emulsion which contains a dye-forming coupler which complements the main sensitivity of the second silver halide emulsion layer.

It is also known to increase the exposure latitude of a photographic product by modifying the silver halide photographic emulsions. For example, it is known to increase the rendering of details by increasing the dispersity of an emulsion in terms of size. It is possible to modify the exposure latitude by using in each of the sensitive layers a mixture of emulsions of different speeds. Such a mixture generally consists of a slow emulsion and a fast emulsion, optionally of one or more emulsions of intermediate speeds. The greater the difference in speed between the fast emulsion and the slow emulsion, the more extensive the exposure latitude.

There is, however, a limitation as regards the choice of the fast emulsion. An emulsion is actually faster if it is formed from coarse grains which make it difficult to develop. There therefore exists a compromise between the extent of the exposure latitude of a photographic product and its developability. Furthermore, in reversible products, an increase in the exposure latitude is often obtained to the detriment of maximum density.

SUMMARY OF THE INVENTION

The object of the present invention is to provide a novel color reversible photographic product which exhibits an increase in the exposure latitude without reducing the maximum density and the developability of the photographic product.

A particular object of the present invention is to provide a photographic product in which the details of the dye image are improved.

DETAILED DESCRIPTION OF THE PREFERRED EMBODIMENT

The present invention concerns a color reversible photographic product comprising a support covered with a blue-sensitive silver halide emulsion layer, a green-sensitive silver halide emulsion layer, and a red-sensitive silver halide emulsion layer, in which at least one of the silver halide emulsion layers comprises a mixture of emulsions containing: (a) at least one polydisperse emulsion whose coefficient of monodispersity (COV) is greater than 50%, (b) at least one monodisperse emulsion whose coefficient of variation (COV) of the grain sizes is below 35%, and (c) at least one emulsion in which greater than 50% of the total projected area of the emulsion grains are accounted for by tabular grains having an aspect ratio greater than or equal to 2, the speed of the tabular grain emulsion being greater than that of the other emulsions of the mixture.

The photographic products of the present invention exhibit an improvement in the details of the dye image without loss in maximum density. Furthermore, the photographic products of the invention exhibit reduced variability to the processing conditions.

According to one embodiment of the invention, the mixture of emulsion is at least present in the blue-sensitive layer and/or in the green-sensitive layer. According to another embodiment, the mixture of emulsions is present in the blue-sensitive layer, in the green-sensitive layer and in the red-sensitive layer.

In the context of the present invention, speed refers to the quantity of light for obtaining a given density. In the present invention, speed is the quantity of light for obtaining a density of 0.8.

The speed of an emulsion is in general proportional to the size of the silver halide grains, although it is possible to modify the speed of the silver halide grains independently of the size.

The difference in speed between the slow emulsion and the fast emulsion can vary to a large degree, but it is preferable to maintain a difference between the fastest emulsion and the slowest emulsion of at least 0.9 Log E, Log E being the logarithm of the exposure.

In the context of the present invention, "tabular grains" refers to grains with two parallel faces wider than the other faces of the grain. These grains can be characterized by their aspect ratio.

The aspect ratio (R) is the ratio of the equivalent circular diameter (ECD) to the average thickness of the grains (e).

Furthermore, "emulsion consisting of tabular grains" refers to an emulsion wherein at least 50% and preferably at least 80% of the total projected grain area are accounted for by tabular grains with an aspect ratio greater than or equal to 2.

The tabular grain emulsions able to be used in the context of the invention are silver bromide, silver iodobromide, silver chloride, silver iodochloride or silver iodochlorobromide emulsions. According to a preferred embodiment, the tabular grain emulsion comprises for the most part of silver bromide. According to a particular embodiment, the tabular grain emulsion consists of silver iodobromide grains.

The silver halide distribution in the grain can be uniform or not. The grains in which the distribution of the halides is non-uniform are for example grains containing at least two types of silver halide in which the halide content varies between the centre of the grain and the surface of the grain. Silver halide grains are known which have a decreasing or increasing silver halide profile. There also exist core-shell grains in which the halide composition of the core is different from that of the shell.

In a conventional manner, these tabular grains are dispersed in a hydrophilic colloidal binder.

The tabular grain emulsions useful for the present invention comprise tabular grains having average thickness below 0.35 $\mu$m, and preferably below 0.3 $\mu$m, and an aspect ratio (R) preferably between 2 and 20. According to one embodiment, the aspect ratio of the tabular grains is between 6 and 10.

The tabular grain emulsions forming the emulsion can be monodisperse or polydisperse.

According to one embodiment of the present invention, the tabular grain emulsion represents between 5 and 50% by weight of the emulsion mixture, and preferably between 5 and 30%.

The tabular grain emulsions can be prepared according to the methods described in *Research Disclosure*, September 1994, Number 36544, Part C (referred to in the remainder of the description as *Research Disclosure*), and in the methods described in U.S. Pat. Nos. 4,439,520, 4,797,354, 5,096,806, 5,147,771, 5,147,772, 5,171,659 and 5,210,013.

The polydisperse and monodisperse emulsions of the photographic product of the present invention consist of silver halide grains dispersed in a colloidal binder. These silver halide grains can have any composition, shape or size known in photography.

These monodisperse or polydisperse silver halide emulsions of the product of the invention can be silver chloride, silver bromide, silver chlorobromide, silver bromochloride, silver chloroiodide, silver bromoiodide or silver iodochlorobromide emulsions.

The distribution of silver halides in the grain can be uniform or not.

In order to further improve the developability of the photographic product, the polydisperse and/or monodisperse silver halide emulsion of the photographic product of the invention comprises for the most part of core/shell grains, preferably having a shell which contains no iodide.

According to a particular embodiment, the shell consists of silver bromide, silver chloride or silver chlorobromide. According to a preferred embodiment, the monodisperse emulsion is a core/shell emulsion with a core consisting of silver bromoiodide and a pure bromide shell. The pure bromide shell enables the development of the photographic product to be initiated more rapidly.

According to a preferred embodiment, the monodisperse emulsion is the slow emulsion of the emulsion mixture and the polydisperse emulsion is the emulsion of intermediate speed.

The mixture of emulsions useful for the present invention preferably comprises 5 to 50% by weight of tabular grain emulsion, and at least 10% by weight of monodisperse emulsion, the quantity of polydisperse emulsion being the remainder to 100%.

In the invention, the polydispersity of the silver halide emulsions is defined on the basis of the coefficient of variation (COV) which, expressed as a percentage, is equal to $(\sigma/D)*100$ in which a is the standard deviation of the population of grains and D is the average size of the grains, represented either by the average diameter when the silver halide grains are circular or by the average value of the equivalent circular diameters (ECD) corresponding to the projected area of the image of the grains.

In the context of the invention, an emulsion is considered to be monodisperse when the COV is less than or equal to 35%, preferably less than 25%. In the same way, an emulsion is considered to be polydisperse when the COV is greater than or equal to 40%.

According to a particular embodiment, the silver halide composition of the photographic product of the present invention corresponds to the formula $AgBr_xCl_yI_z$ in which $x+y+z=1$ and $z \leqq 0.05$. According to a particular embodiment, the silver halide composition of the photographic product corresponds to the formula $AgBr_xCl_yI_z$, in which $x+y+z=1$ and $0.03 \leqq z \leqq 0.05$ In order to obtain an extended exposure latitude, it is, moreover, preferable to use a photographic product in which the distribution of iodide in the photographic product is homogeneous, that is to say the variation in the silver iodide content between two sensitive layers is such that $\Delta(z_n - Z_m) \leqq 0.05$, $Z_n$ and $z_m$ being the average silver iodide contents of each of these layers. This homogeneity in the iodide content of the layer further increases the exposure latitude.

According to a particular embodiment, the emulsions which constitute the mixture of emulsions of the photographic product of the invention, that is to say the polydisperse emulsion, the monodisperse emulsion and the tabular grain emulsion, are emulsions which contain silver iodide, the iodide content of each of the emulsions not exceeding 5% molar with respect to the total quantity of silver halides forming the emulsion.

The emulsions useful for the present invention can be prepared according to different methods known and described in *Research Disclosure*, Section I-C.

The hydrophilic colloidal binder frequently used to manufacture the emulsions is generally gelatin or a gelatin derivative. This gelatin can be replaced in part by other synthetic or natural hydrophilic colloids such as albumen, casein, zein, a polyvinyl alcohol, cellulose derivatives such as carboxymethylcellulose for example. Such colloids are described in Section II of *Research Disclosure*.

The silver halide emulsions of the present invention can be chemically sensitized as described in *Research Disclosure*, Section IV. In a conventional fashion, the emulsions are sensitized with sulfur, selenium and/or gold. It is also possible to sensitize the emulsions chemically by reduction.

The silver halide emulsions can be sensitized spectrally as described in *Research Disclosure*, Section V. The conventional sensitizing dyes are polymethine dyes, which comprise cyanines, merocyanines, complex cyanines and merocyanine, oxonols, hemioxonols, styryls, merostyryls, streptocyanines, hemicyanines and arylidenes.

The color photographic product of the invention comprises in a conventional fashion dye-forming couplers with 2 or 4 equivalents. These couplers react with the color developer in its oxidized form to form respectively a cyan, magenta or yellow image dye. These couplers are generally colorless and non-diffusable. According to another known embodiment, these couplers are contained in the development bath.

The cyan dye-forming couplers which can be used in the context of the present invention are described in *Research Disclosure*, Part X. Such couplers were described in U.S. Pat. Nos. 2,367,531, 2,423,730, 2,474,293, 2,77,162, 2,895,826, 3,200,836, 3,034,892, 3,041,236, 4,333,999 and 4,883,746. Preferably, these couplers are phenols or naphthols.

The magenta dye-forming couplers which can be used in the context of the present invention are described in *Research Disclosure*, Part X. Such couplers were described in U.S. Pat. Nos. 2,311,082, 2,343,703, 2,369,489, 2,600,788, 2,908,573, 3,062,653, 3,152,896 and 3,519,429. Preferably, these couplers are pyrazolones, pyrazolotriazoles or pyrazolobenzimidazoles.

The yellow dye-forming couplers which can be used in the context of the present invention are described in *Research Disclosure*, Part X. Such couplers were described in U.S. Pat. Nos. 2,298,443, 2,407 210, 2,875,057, 3,048,194, 3,265,506, 3,447,928, 4,022,620 and 4,443,536. Conventionally, these couplers are open chain ketomethylene compounds.

In addition to the compounds cited previously, the photographic product can contain other useful photographic compounds, for example coating aids, stabilizing agents, plasticizers, anti-fog agents, tanning agents, antistatic agents, matting agents, etc. Examples of these compounds are described in *Research Disclosure*, Sections VI, VII, VIII, X.

The supports which can be used in photography are described in Section XV of *Research Disclosure*; Section XV. These supports are generally polymer supports such as cellulose, polystyrene, polyamide or polyvinyl polymers, polyethylene or polyester, paper or metal supports.

The photographic products can contain other layers, for example a protective top layer, inter mediate layers, an antihalation layer, an anti-UV layer, an antistatic layer, etc. These different layers and their arrangements are described in Section XI of *Research Disclosure*. In addition to the emulsions described above, the product of the invention can contain other emulsions known in the field of photography.

The following examples illustrate the present invention in greater detail.

EXAMPLES

Example 1 (control)

A color reversible photographic product was prepared which had the following structure (content in g/m$^2$):

Layer 1 Protective top layer containing a 50/50 bromochloride emulsion with fine grains not sensitive to light (0.025)

Layer 2 Anti-UV layer containing gelatin (1) and a compound which absorbs ultraviolet (5, 6).

Layer 3 Blue-sensitive layer, comprising
- an AgBrI (3.4% mol.I) polydisperse emulsion (85% by weight)(COV 50%), ECD=1 μm,
- an AgBrI (3.7% mol.I) Core/Shell emulsion (15% by weight) with octrahedral grains, ECD=0.73 μm Yellow dye-forming coupler (0.8) COUP-1 Blue-sensitizing spectral dye COL-1 Silver content (0.4) Gelatin content (1.4)

Layer 4 Filter layer comprising yellow colloidal silver (0.15) and gelatin (0.8)

Layer 5 Green-sensitive layer, comprising
- a polydisperse emulsion (Em.A)(72% by weight) (AgBrI (3.4% mol.I) (COV=50%), ECD=1 μm,
- an AgBrI (3.7% mol.I) Core/Shell emulsion (Em.B) (12% by weight) AgBrI (3.7% mol.l) with octrahedral grains, ECD=0.8 μm
- an AgBrI (3.7% mol.I) Core/Shell emulsion (Em.C) (16% by weight) with octrahedral grains, ECD=0.5 μm Magenta dye-for mning coupler (0.4) (COUP-2) Green-sensitizing spectral dye (COL-2) Silver content (0.25) Gelatin content (0.7)

Layer 6 Layer containing gray colloidal silver (0.05) and gelatin (1.1)

Layer 7 Red-sensitive layer, comprising
- an AgBrI (3.4% mol.I) core/shell emulsion (55% by weight) with octrahedral grains, ECD=1.15 μm,
- an AgBrI (3.7% mol.I) Core/Shell emulsion (21% by weight) with octrahedral grains, ECD=0.6 μm
- an AgBrI (3.7% mol.I) core/shell emulsion (24% by weight) with octrahedral grains, ECD=0.5 μm cyan dye-forming coupler (0.45) (COUP-3) Red-sensitizing spectral dye (COL-3) Silver content (0.3) Gelatin content (0.95)

Layer 8 Gelatin+Lippman emulsion

Support Paper support covered with a layer of polyethylene.

The Core/Shell emulsions are emulsions with monodisperse octrahedral grains (COV≦35%) whose core consists of AgBrI and whose shell consists of AgBr.

Blue-sensitizing spectral dye: COL-1
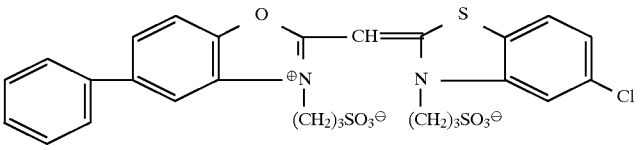
Green-sensitizing spectral dye: COL-2
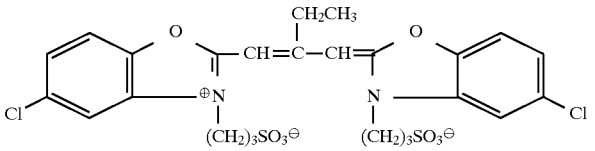
Red-sensitizing spectral dyes: COL-3
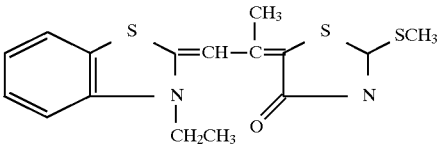
et
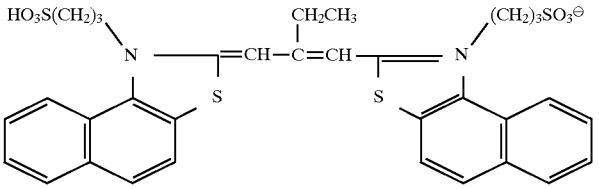
Yellow dye-forming coupler: COUP-1
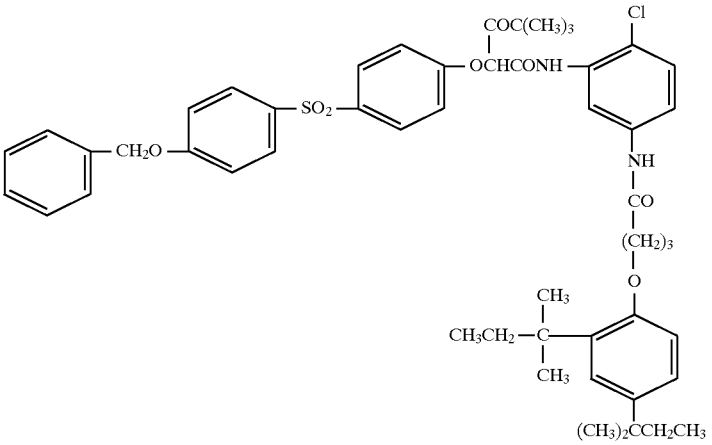
Magenta dye-forming coupler: COUP-2
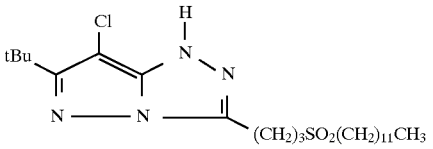

-continued

Cyan dye-forming coupler: COUP-3

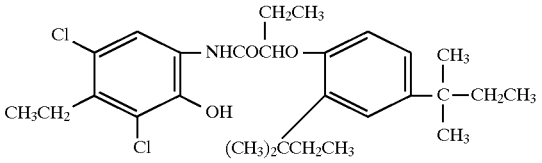

A sample of the photographic product described above was exposed with a tungsten lamp (color temperature 2850°K.) for ½ second through a neutral sensitometric wedge.

Following exposure, these samples were processed in an AUTOPAN® automatic processing machine comprising conventional KODAK® Ektachrome® R-3 processing baths.

The standard R-3 Ektachrome® processing comprises the following steps:

Black and white development 1 min 15

Washing 1 min 30

Re-exposure

Color development 2 min 15

Washing 0 min 45

Bleaching/fixing 2 min

Washing 2 min 15

Using an X-Rite densitometer equipped with an A status the following sensitometric characteristics were determined for each of the red, green and blue sensitive layers.

1) the shoulder density (0.5SD) which is represented by the density at an exposure 0.5 LogE below the exposure giving a density of 0.8.
2) the shoulder density (0.9SD) which is represented by the density at an exposure 0.9 LogE below the exposure giving a density of 0.8.
3) the toe density (0.4TD) which is represented by the density at an exposure 0.4 LogE above the exposure giving a density of 0.8.
4) the toe density (0.8TD) which is represented by the density at an exposure 0.4 LogE above the exposure giving a density of 0.8.
5) the maximum density (Dmax) which corresponds to the density of a non-exposed area.
6) the minimum density (Dmin) which is represented by the density at an exposure 1.5 LogE above the exposure giving a density of 0.8.

The sensitometric results obtained are set out in Table 1 below.

Example 2

A photographic product identical to that described was then prepared, except that in the green-sensitive layer an AgBrI (4.1 % mol.I) tabular grain emulsion (thickness 0.13 μm, ECD=1.3 μm) was introduced and COL-2 was replaced by COL-2' with the formula:

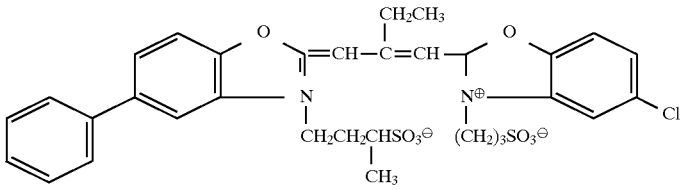

A layer was thus obtained which contains a mixture of emulsions comprising 8% by weight of tabular grain emulsion, 64% by weight of polydisperse emulsion (Em.A), 13% by weight of emulsion (Em.B), and 15% by weight of emulsion (Em.C).

The speed of each of the emulsions was such that the speed of the tabular grain emulsion was greater than that of the emulsion Em.C by 1.5 Log E, the speed of the emulsion Em.A was greater than that of the emulsion Em.C by 0.9 Log E, the speed of the emulsion Em.B was greater than that of the emulsion Em.C by 0.6 Log E, the emulsion Em.C being the slowest emulsion of the mixture (speed measured in single-layer format).

The tabular grain emulsion was prepared by double-jet precipitation, with ripening in ammonia solution. The iodide was introduced throughout the growth of the grains with an addition, all at once, of an additional quantity of iodide at the end of growth.

A sample of this photographic product was exposed, developed and analyzed according to the method described previously. The sensitometric results obtained are set out in Table 1 below.

Example 3

A photographic product identical to that described in Example 2 was then prepared, except that the quantity of tabular grain emulsion was increased.

A layer was thereby obtained which contains a mixture of emulsions comprising 19% by weight of tabular grain emulsion, 50% by weight of polydisperse emulsion (Em.A), 11% by weight of emulsion (Em.B) and 20% by weight of emulsion (Em.C).

A sample of this photographic product was exposed, developed and analyzed according to the method described previously. The sensitometric results obtained are set out in Table 1 below.

Example 4

A photographic product identical to that described previously in Example 3 was prepared, except that the quantity of tabular grain emulsion was increased.

A layer was thereby obtained which contained a mixture of emulsions comprising 30% by weight of tabular grain emulsion, 35% by weight of polydisperse emulsion (Em.A), 10% by weight of emulsion (Em.B) and 25% by weight of emulsion (Em.C).

A sample of this photographic product was exposed, developed and analyzed according to the method described previously. The sensitometric results obtained are set out in Table 1 below.

Results

TABLE 1

| | | 0.5SD | 0.9SD | 0.4TD | 0.8TD | Dmin | Dmax |
|---|---|---|---|---|---|---|---|
| Ex 1 | (1) | 1.52 | 2.10 | 0.29 | 0.14 | 0.13 | 2.32 |
| Ex 1 | (2) | 1.48 | 1.95 | 0.35 | 0.13 | 0.12 | 2.26 |
| Ex 1 | (3) | 1.48 | 2.10 | 0.30 | 0.12 | 0.12 | 2.30 |
| Ex 2 | (2) | 1.45 | 1.90 | 0.39 | 0.14 | 0.11 | 2.25 |
| Ex 3 | (2) | 1.40 | 1.85 | 0.36 | 0.13 | 0.11 | 2.28 |
| Ex 4 | (2) | 1.38 | 1.76 | 0.33 | 0.13 | 0.12 | 2.32 |

(1) sensitometric characteristics of the emulsion layer sensitive to red light
(2) sensitometric characteristics of the emulsion layer sensitive to green light
(3) sensitometric characteristics of the emulsion layer sensitive to blue light These results show that, with the photographic product of the present invention, the value of the density at the shoulder (0.5SD and 0.9SD) is reduced and the density at the toe (0.4TD and 0.8TD) is increased in the sensitometric curve of the magenta layer. These variations increase the exposure latitude of the magenta layer. When red images are to be reproduced, this increase in the exposure latitude of the magenta layer affords better reproduction of details in the red region. With the photographic product of the present invention, the overall contrast of the photographic product is reduced without reducing the maximum density.

Example 5

In this example, the photographic product of Example 3 was modified by introducing into the blue-sensitive layer a tabular grain emulsion (thickness 0.13 $\mu$m, ECD=2.93 $\mu$m) AgBrI (4.1% I. Mol.).

A layer was thereby obtained which was sensitive to blue light and which contained a mixture of emulsions comprising 9% by weight of tabular grain emulsion, 77% by weight of polydisperse emulsion and 14% by weight of monodisperse emulsion.

The speed of each of these emulsions was such that the speed of the tabular grain emulsion was greater than that of the monodisperse emulsion by 1.3 Log E, and the speed of the polydisperse emulsion was greater than that of the monodisperse emulsion by 0.5 Log E, the monodisperse emulsion being the slowest emulsion of the mixture (speed measured in single-layer format).

A sample of this photographic product was exposed and processed according to the method in Example 1.

The following sensitometric results are thus obtained:

TABLE 2

| | | 0.5SD | 0.9SD | 0.4TD | 0.8TD | Dmin | Dmax |
|---|---|---|---|---|---|---|---|
| Ex 1 | (1) | 1.52 | 2.10 | 0.29 | 0.14 | 0.13 | 2.32 |
| Ex 1 | (2) | 1.48 | 1.95 | 0.35 | 0.13 | 0.12 | 2.26 |
| Ex 1 | (3) | 1.48 | 2.10 | 0.30 | 0.12 | 0.12 | 2.30 |
| Ex 3 | (3) | 1.52 | 2.05 | 0.29 | 0.12 | 0.10 | 2.40 |
| Ex 5 | (3) | 1.48 | 2.0 | 0.30 | 0.13 | 0.11 | 2.34 |

(1) sensitometric characteristics of the emulsion layer sensitive to red light
(2) sensitometric characteristics of the emulsion layer sensitive to green light
(3) sensitometric characteristics of the emulsion layer sensitive to blue light These results show as before that the photographic product in Example 5 has a generally softened contrast without impairment of the Dmax and Dmin, by virtue of the increase in the exposure latitude of the yellow and magenta layer. Such a product has improved details.

Example 6

In this example, samples of the control photographic product in Example 1 and samples of the photographic product of the invention in Example 5 were exposed and developed according to the method in Example 1. For each sample, the development time in the first developer and in the color developer was varied. The densities obtained at the shoulder (0.5SD) and at the toe (0.4TD) of the sensitometric curves corresponding to each of the sensitive layers of the photographic product were measured.

The following sensitometric results are obtained:

| | | First Developer | | | | | | Color Developer | | | | | |
|---|---|---|---|---|---|---|---|---|---|---|---|---|---|
| | | 0.4TD | | | 0.5SD | | | Dmax | | | Dmax | | |
| | | 60s | 75s | 90s | 60s | 75s | 90s | 60s | 75s | 90s | 105s | 135s | 200s |
| Ex 1 | (1) | 0.33 | 0.32 | 0.33 | 1.53 | 1.49 | 1.48 | 2.67 | 2.62 | 2.58 | 2.58 | 2.63 | 2.66 |
| Ex 1 | (2) | 0.35 | 0.37 | 0.40 | 2.00 | 1.44 | 1.41 | 2.49 | 2.41 | 2.31 | 2.38 | 2.45 | 2.48 |
| Ex 1 | (3) | 0.30 | 0.31 | 0.33 | 1.49 | 1.47 | 1.45 | 2.32 | 2.28 | 2.23 | 2.20 | 2.31 | 2.36 |
| Ex 5 | (1) | 0.25 | 0.26 | 0.28 | 1.58 | 1.52 | 1.51 | 2.49 | 2.47 | 2.44 | 2.37 | 2.42 | 2.46 |
| Ex 5 | (2) | 0.34 | 0.34 | 0.35 | 1.49 | 1.46 | 1.44 | 2.52 | 2.49 | 2.43 | 2.45 | 2.52 | 2.53 |
| Ex 5 | (3) | 0.27 | 0.28 | 0.29 | 1.52 | 1.50 | 1.46 | 2.42 | 2.40 | 2.34 | 2.24 | 2.34 | 2.37 |

If the variation in the sensitometric characteristics is compared between 60 s and 90 s of processing in the first developer and between 105 and 200 s of processing in the color developer, it is clear that the photographic product of the invention has a reduced sensitivity to processing conditions. Furthermore, the developability of the photographic product of the invention is comparable to that of the control photographic product.

These examples show that the photographic product of the present invention affords an improvement in the details of the dye image by virtue of the reduction in the overall contrast, without deterioration in the maximum density nor in the developability of the photographic product.

The invention has been described in detail with particular reference to certain preferred embodiments thereof, but it will be understood that variations and modifications can be effected within the spirit and scope of the invention.

We claim:

1. Color reversible photographic product comprising a support covered with a blue-sensitive silver halide emulsion layer, a green-sensitive silver halide emulsion layer and a red-sensitive silver halide emulsion layer, wherein at least one of the silver halide emulsion layers comprises a mixture of emulsions containing:

(a) at least one polydisperse emulsion having a coefficient of monodispersity (COV) is greater than 50%, (b) at least one monodisperse emulsion having a coefficient of variation (COV) is below 35%, and (c) at least one emulsion in which greater than 50% of the total projected area of the emulsion grain are accounted for by tabular grains having an aspect ratio greater than or equal to 2, the speed of the tabular grain emulsion being greater than that of the other emulsions of the mixture.

2. Photographic product according to claim 1, wherein the monodisperse emulsion is the slow emulsion of the mixture.

3. Photographic product according to claim 1, wherein the monodisperse and/or polydisperse emulsions are emulsions with a silver bromoiodide core and shell, the iodide being present for the most part in the shell.

4. Photographic product according to claim 1, wherein the silver halide composition of the product corresponds to the formula $AgBr_xCl_yI_z$ in which the sum x+y+z is equal to 1 and z is less than or equal to 0.05.

5. Photographic product according to claim 1, wherein the monodisperse emulsion is a core/shell emulsion whose core consists of AgBrI and whose shell consists of AgBr.

6. Photographic product according to claim 1 wherein the polydisperse emulsion is an AgBrI emulsion with a homogeneous structure.

7. Photographic product according to claim 1, wherein the tabular grain emulsion is an AgBrI emulsion with a homogeneous structure.

8. Photographic product according to claim 1, wherein the iodide content of each of the emulsions does not exceed 5% mol. in silver iodide, with respect to the total quantity of silver halides of the emulsion.

9. Photographic product according to claim 1, wherein the tabular grain emulsion represents between 5 and 50% by weight of the mixture, the monodisperse emulsion represents at least 10% by weight of the mixture and the polydisperse emulsion makes it up to 100%.

* * * * *